US005281938A

United States Patent [19]

Okuyama et al.

[11] Patent Number: 5,281,938

[45] Date of Patent: Jan. 25, 1994

[54] DEFLECTION SYSTEM

[75] Inventors: Nobutaka Okuyama; Souichi Sakurai, both of Yokohama; Masaki Nakahara, Chigasaka; Michitaka Ohsawa, Fujisawa; Ichiri Niitsu, Yokohama, all of Japan

[73] Assignee: Hitachi, Ltd., Tokyo, Japan

[21] Appl. No.: 760,961

[22] Filed: Sep. 17, 1991

[30] Foreign Application Priority Data

Sep. 19, 1990 [JP] Japan ..... 2-247078

[51] Int. Cl.[5] ..... H01F 7/00

[52] U.S. Cl. ..... 335/210; 335/213

[58] Field of Search ..... 335/210, 211, 212, 213

[56] References Cited

U.S. PATENT DOCUMENTS 4,511,871 4/1983 Schier, Jr. et al. ..... 335/213

5,039,922 8/1991 Ogasa et al. ..... 335/210

*Primary Examiner*—Lincoln Donovan

*Attorney, Agent, or Firm*—Antonelli, Terry, Stout & Kraus

[57] ABSTRACT

A deflection system for a cathode-ray tube including a horizontal deflection core, a magnetic coil, and a vertical deflection coil toroidally wound on the magnetic core. The vertical deflection coil has a plurality of superimposed winding layers arranged with respect to a vertical axis of the deflection system with at least one of the layers of the vertical deflection coil being disposed asymmetrically with respect to the vertical axis or disposed symmetrically with respect to the vertical axis and having winding portions delimiting at least one gap along an extent thereof at a position other than the vertical axis. In this manner, an induced voltage in the at least one of the layers is substantially equal to an induced voltage in each of another of the layers at least in the region of the vertical axis, whereby ringing is substantially prevented.

21 Claims, 8 Drawing Sheets

DEFLECTION SYSTEM

BACKGROUND OF THE INVENTION

The present invention relates to a deflection system for a cathode-ray tube, particularly to a deflection system for enabling a decrease of ringing.

According to conventional devices of this type, as described in Japanese Patent Laid Open No. 34549/83, first and second resistors are respectively connected between a central connection point of a deflecting coil wound in a toroidal fashion around a core between winding start and end points of the coil, and the resonance of a resonance circuit formed by a deflection system and a floating capacity induced between lines of winding layers of the toroidally wound deflecting coil is damped to reduce ringing which causes light and dark stripes in a reproduced image reproduced on a cathode-ray tube simultaneously with the above resonance.

Referring to FIG. 1, there is illustrated a conventional winding method for a conventional vertical deflecting coil, in which the ordinate represents the number of each winding layer, while the abscissa represents the angle $\theta$ of each winding. In the figure, (1) represents a first layer, a second layer, (2) . . . and (5) a fifth layer. A vertical axis 6 extends through the center of the vertical deflecting coil. According to the winding method shown in FIG. 1, the winding for layer (1) starts from a winding start point 10 at a $-70°$ point and ends at $+70°$ point with return being made to the $-70°$ point using a return line 12 (indicated by a dotted line). The second-layer (2) winding starts from the $-70°$ point and ends at the $+70°$ point with a return being made to a $-50°$ point. Then a third-layer (3) winding starts from the $-50°$ point and ends at the $+50°$ point, with return being made to the $-50°$ point. The fourth-layer (4) winding also starts from the $-50°$ point and ends at the $+50°$ point with return being made to a $-30°$ point; and a fifth-layer (5) winding starts from the 30° point and ends at a winding end point 14 at a $+30°$ point. Thus, in the winding method shown in FIG. 1, all the winding layers are approximately symmetric with respect to the vertical axis 6.

FIG. 2 illustrates the distribution of induced voltages from a horizontal deflecting coil relative to the vertical deflecting coil wound according to the winding method shown in FIG. 1. In FIG. 2, a normalized induced voltage distribution curve of the first and second layers (1) and (2) exhibits an increase from 0° at the $-70°$ point with respect to the vertical axis 6 and reaches a maximum at the 0° point, and after passing the 0° point, exhibits a decrease until becoming 0° at $+70°$ point. The reason why a change is made from increase to decrease at the 0° point is because the voltage induced in the coil of a small number of windings is inverted in polarity between positive and negative sides of angle $\theta$ with respect to 0° as a boundary. An induced voltage distribution of the third and fourth layers (3) and (4) increases from 0° at the $-50°$ point and reaches a maximum at the 0° point, then after passing the 0° point, it decreases until it becomes 0° at the $+50°$ point. The induced voltage distribution of the fifth layer (5) increases from 0° at the $-30°$ point and reaches a maximum at the 0° point, then after passing the 0° point, it decreases until it becomes 0° at the $+30°$ point.

In FIG. 2, the induced voltage at the winding start point of the coil is assumed to be 0° and differences are developed in the following relation among the induced voltage of the first and second layers, induced voltage of the third and fourth layers, and induced voltage of the fifth layer: (1st and 2nd layer induced voltage)>(3rd and 4th layer induced voltage)>(5th layer induced voltage). This relation is valid on the condition that the winding pitch (rad/turn) is constant and that all the winding layers are approximately symmetric with respect to the vertical axis 6.

In the winding method shown in FIG. 1, as mentioned above, there is developed a voltage difference of [(1st and 2nd layer induced voltage)−(3rd and 4th layer induced voltage)], i.e., an inter-layer voltage difference 8.

On the other hand, FIG. 3 is an electrical equivalent circuit diagram of a deflection system related to a ringing phenomenon which ringing is generated in the deflection system. In FIG. 3, there is shown a deflection system 1 including a horizontal deflection coil 2 supplied with power from a horizontal deflection circuit 2' and a vertical deflection coil 3 magnetically coupled with the horizontal deflection coil. Only half of the upper and lower portions of the vertical deflection coil is illustrated in FIG. 3, and a connection circuit to a vertical deflection circuit is omitted because it has nothing to do with the occurrence of ringing. The vertical deflection coil 3 is divided into a negative-side coil **3*a* and a positive-side coil 3*b*, with angle $\theta$, on both sides of the vertical axis 6. The coils 3*a* and 3*b* are magnetically coupled to the horizontal deflection coil 2 (supplied with electric power from the horizontal deflection circuit 2') so as to be opposite in polarity to each other. Since the winding layers of the vertical deflecting coil 3 are stacked successively, an inter-layer floating capacity 9 is present between adjacent winding layers. Between the winding layers which are different in winding start angle from each other, there occurs the inter-layer potential difference 8 corresponding to only an induced voltage which varies in such angular range. Consequently, a voltage corresponding to the inter-layer potential difference 8 is developed relative to the inter-layer floating capacity 9 developed between adjacent winding layers of the vertical deflecting coil 3, thus causing resonance, and hence the occurrence of ringing. As to the ringing phenomenon generated in the deflection system, ringing caused by the inter-layer floating capacity 9 of the vertical deflection coil is more predominant than ringing caused by an inter-line floating capacity of the winding layers. Heretofore, no consideration has been given to decreasing the ringing caused by the inter-layer floating capacity 9**. Additionally, a satisfactory ringing diminishing effect is not obtained in the case of a high horizontal deflection frequency. In the prior art, moreover, since a damping resistor is used, the working efficiency is poor and the manufacturing cost increases.

SUMMARY OF THE INVENTION

It is the object of the present invention to provide a deflection system for reducing an inter-layer potential difference of the voltage induced in a vertical deflection coil by a horizontal deflection magnetic field, and thereby diminish ringing without using a damping resistor.

According to a feature of the present invention, there is provided a deflection system having a vertical deflection coil wound in a toroidal fashion, the vertical deflection coil having at least one winding layer which is asymmetric in winding density distribution with respect to an axis of symmetry, a winding end position of the at least one winding layer and a winding start position of the adjacent winding layer being approximately symmetric with respect to the axis of symmetry.

According to another feature of the present invention, a deflection system has a vertical deflection coil wound in a toroidal form approximately symmetrically with respect to an axis of symmetry, wherein the vertical deflecting coil has at least one winding layer including a hollow portion not containing the axis of symmetry.

By the formation of a winding layer which is asymmetric with respect to the axis of symmetry or by the formation of a winding layer which has a hollow portion not containing the axis of symmetry, there can be realized a winding distribution which diminishes an inter-layer potential difference of voltage induced in the vertical deflection coil by a horizontal deflection magnetic field of high frequency, whereby the resonance caused by an inter-layer floating capacity can be prevented and therewith obtain a reduction of ringing.

These and further objects, features and advantages of the present invention will become more obvious from the following description when taken in connection with the accompanying drawings which show for purposes of illustration only, several embodiments in accordance with the present invention.

DESCRIPTION OF THE PREFERRED EMBODIMENTS

Figure 4A:
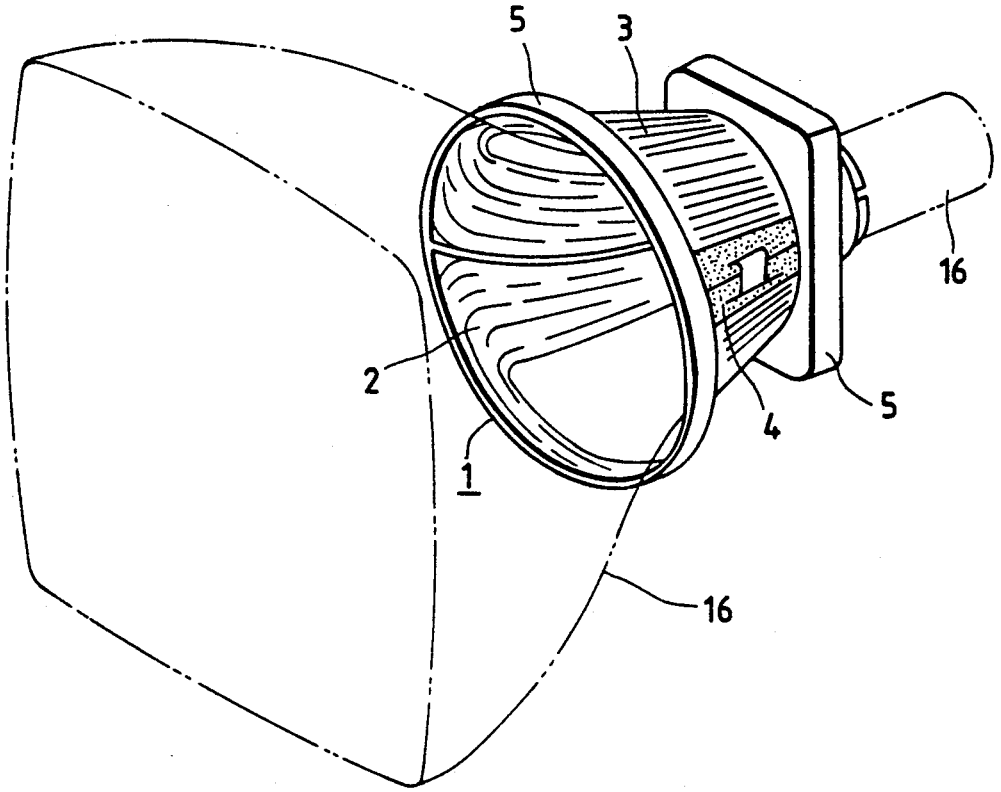
FIG. 4 illustrates a deflection system according to an embodiment of the present invention, in which (a) is a perspective view, (b) is a front view of a principal portion and (c) is an explanatory view of a winding method thereof.
Figure 4B:
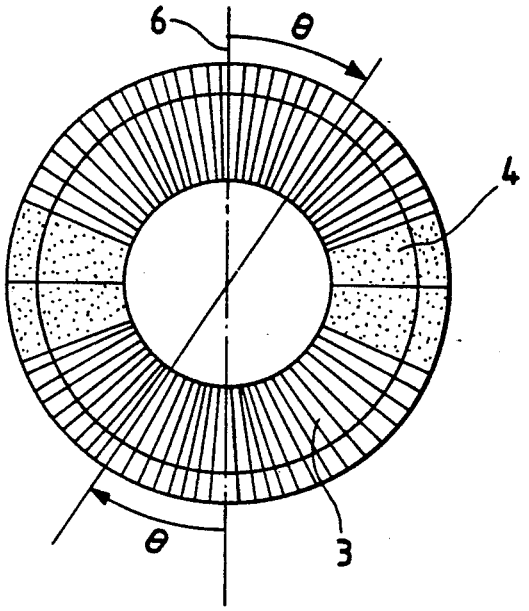
Figure 4C:
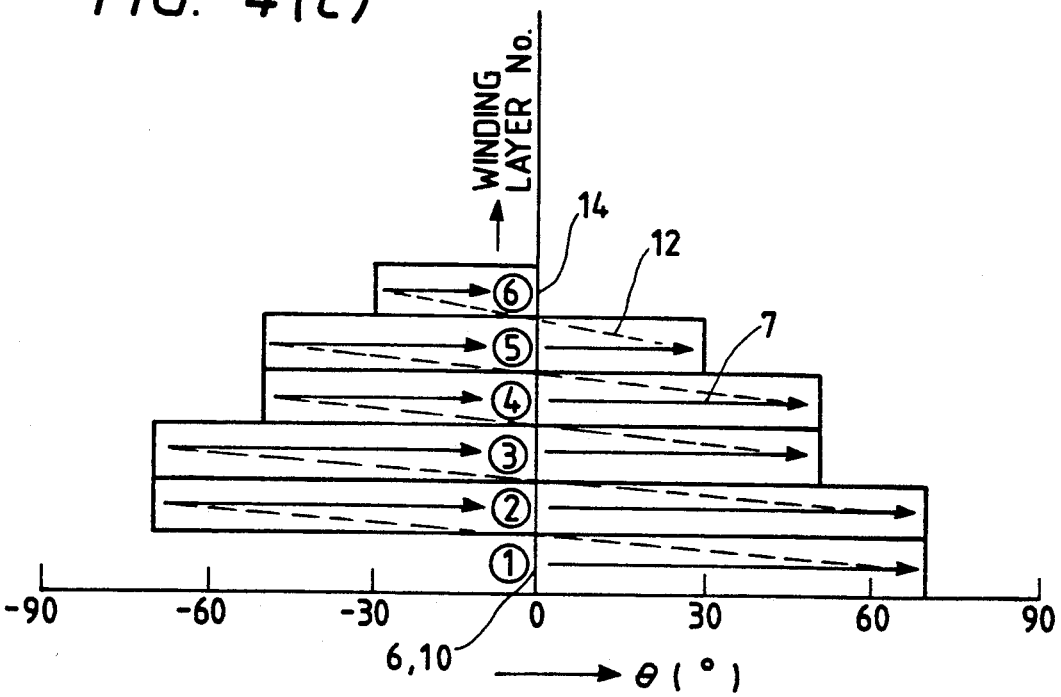

FIG. 4 illustrates an embodiment of the present invention, in which FIG. 4(*a*) is a perspective view, FIG. 4(*b*) is a front view of a principal portion and FIG. 4(*c*) is an explanatory view of a winding method. In these figures, there is shown a deflection system 1 for a cathode ray tube 16 (shown in dashed line), a horizontal deflection coil 2 and a vertical deflection coil 3, a magnetic core 4 formed of a magnetic material, and a separator 5 formed of an insulating material. The vertical axis 6 passes through the center of the vertical deflection coil 3. There is also shown a winding start position 10, a winding return line 12, and a winding end position 14.

Figure 5:
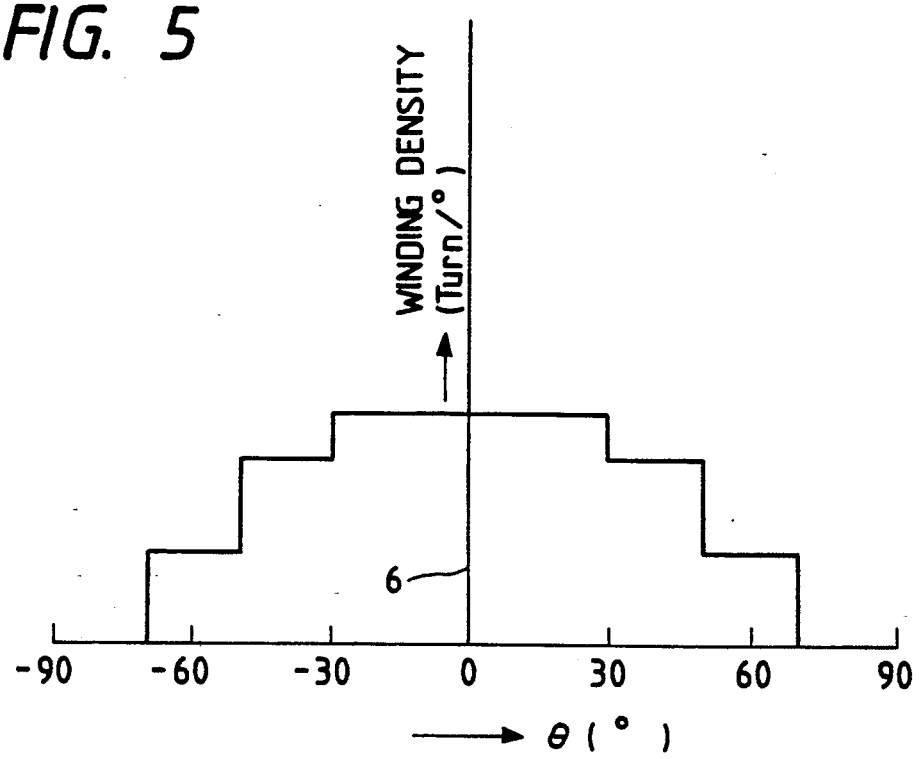
FIG. 5 is an explanatory view of a winding density distribution based on the winding method of FIG. 4(*c*)

As shown in FIG. 4(*a*), the deflection system 1 includes the horizontal deflection coil 2 which is in the shape of a saddle, the vertical deflection coil 3 which is wound in a toroidal form on the magnetic core 4, and the separator 5. When the angle to the vertical axis 6 is $\theta$ as shown in FIG. 4(*b*), the winding method for the vertical deflection coil 3 is set as shown in FIG. 4(*c*) In FIG. 4(*c*), ① represents a first winding layer of the deflection coil, ② represents a second winding layer, . . . and ⑥ to a sixth winding layer. The first winding layer starts from the vertical axis 6 and ends at a $+70°$ point and then shifts by one of the return lines 12 to a $-70°$ point. The second layer starts from the $-70°$ point and ends at the $+70°$ point with return being made to the $-70°$ point. The third layer starts from the $-70°$ point and ends at a $+50°$ point with return being made to a $-50°$ point. The fourth layer starts from the $-50°$ point and ends at the $+50°$ point with return being made to the and ends at a $+30°$ point with return being made to a $-30°$ point, and the sixth layer starts from the $-30°$ point and ends at a 0° point, i.e., the vertical axis 6. In the vertical deflection coil 3 which is wound on the magnetic core 4, the winding layers are stacked or superimposed on the core 4 successively in the order of the winding. A winding density distribution (turn/°) in the entire vertical deflection coil of FIG. 4(*c*) which influences the shape of a magnetic field created and the performance of the deflecting system 1 is symmetric with respect to the vertical axis 6, as shown in FIG. 5.

As described above, a winding layer asymmetric relative to the vertical axis 6 is formed, and a winding end position of this winding layer and a winding start position of the next winding layer are symmetric with respect to the vertical axis 6. This symmetric relation is expressed as follows:

$$\theta 2,\, i = -\theta 1,\, i+l \qquad (1)$$

where $\theta 2$, i: winding end angle of the 1th layer, $\theta 1$, i+1: winding start angle of the i+1th layer.

On the other hand, the voltage, Ei, induced in the 1th layer of the vertical deflection coil by a horizontal deflection magnetic field can be approximated by the following equation because the interlinkage magnetic flux density of the horizontal deflection magnetic field for one turn of the coil positioned at the angle $\theta$ is substantially proportional ti sin $\theta$:

$$\begin{aligned} Ei &= E_1,\, i - \int_{\theta 1,i} K_1 \cdot ni(\theta) \cdot \sin\theta \, d\theta \\ &= E_1,\, i + K_2 (\cos\theta - \cos\theta 1,\, i) \end{aligned} \qquad (2)$$

where, $E_1$, i: winding start potential of the 1th layer, ni($\theta$): winding density distribution of the 1th layer (turn/rad), K1: constant, $K_2$: constant (constant winding pitch without hollow portion), $\theta 1$, i: winding start angle of the 1th layer.

Figure 6:
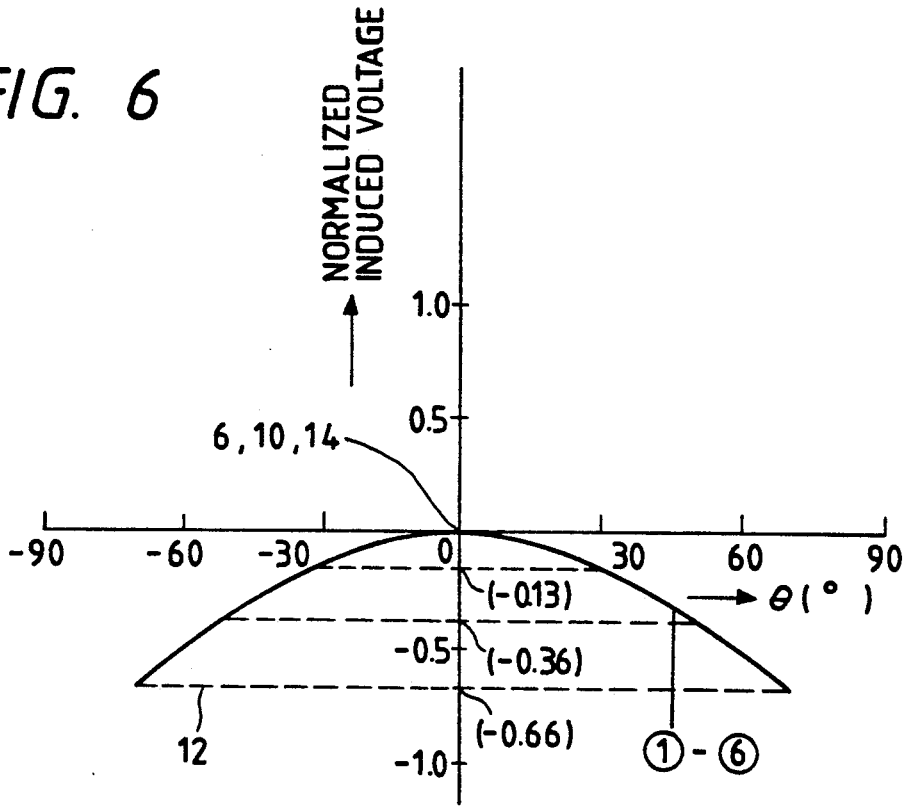
FIG. 6 is an explanatory view of induced voltages in the embodiment of FIG. 4(*c*)

FIG. 6 illustrates a distribution of normalized values obtained by dividing induced voltages in the vertical deflection coil by K2. If the induced voltage at the start of winding in the normalized induced voltage distribution curve in FIG. 6 is 0, the induced voltage of the first layer decreases from 0 because a winding starts from the vertical axis 6 and becomes minimum (−0.66) at a +70° point with return being made to a −70° point. The induced voltage of the second layer increases from the −70° point and becomes a maximum (0) at a 0° point, and after passing the 0° point, it decreases until reaching a minimum (31 0.66) at the +70° point with return being made to −70° point. The induced voltage of the third layer increases from the −70° point and becomes the maximum (0) at the 0° point, then after passing the 0° point, it decreases until reaching a minimum (−0.36) at a +50° point and return being made to a −50° point. The induced voltage of the fourth layer increases from the −50° point and becomes the maximum (0) at the 0° point, and after passing the 0° point, it decreases until reaching the minimum (−0.36) at the +50° point with return being made to a −50° point. The induced voltage of the fifth layer increases from the −50° point and becomes the maximum (0) at the 0° point, and after passing the 0° point, it decreases until reaching a minimum (−0.13) at a +30° point with return being made to a −30° point. The induced voltage of the sixth layer increases from the −30° point and becomes the maximum the (0) at the 0° point. Thus, the induced voltage curves of the winding layers overlap each other as a single curve, as shown in FIG. 6, and the inter-layer potential difference 8 is 0. Therefore, resonance does not occur, even in the presence of an inter-layer floating capacity 9, whereby ringing can be diminished.

Figure 7:
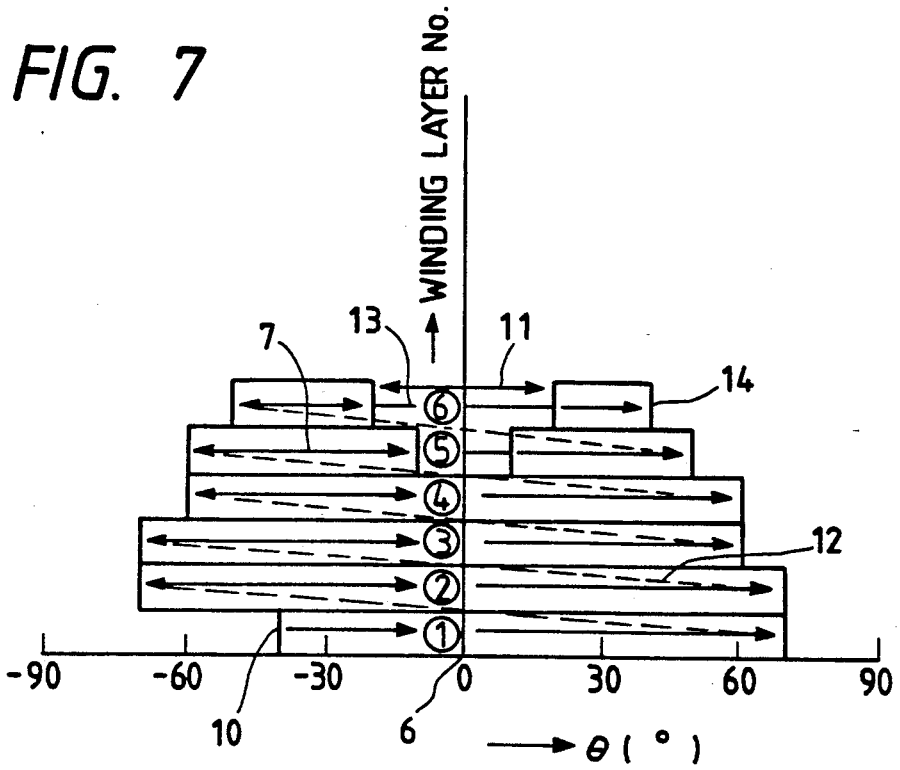
FIG. 7 is an explanatory view of a winding method in accordance with another embodiment of the present invention.
Figure 8:
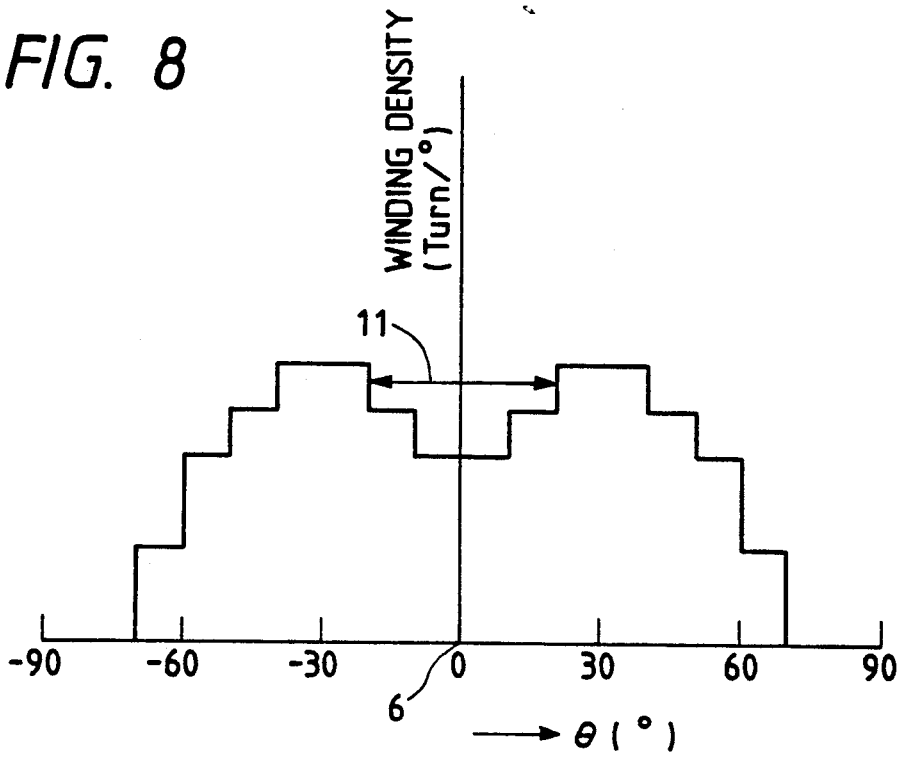
FIG. 8 is an explanatory view of a winding density distribution based on the winding method of FIG. 7.

Another embodiment of the present invention is illustrated in FIG. 7, which is an explanatory view of a winding method for the vertical deflection coil 3. In FIG. 7, hollow portion feed line 13 connects winding portions of the layer delimiting a hollow portion 11 of the winding layer. The entire vertical deflecting coil in this embodiment is formed so that a winding density distribution is symmetric with respect to a vertical line ($\theta=0°$), and with the hollow portion 11 being formed, as shown in FIG. 8. According to the winding method of this embodiment, as shown in FIG. 7, the first layer starts from a −40° point with respect to the vertical axis 6 and ends a +70° point with return being made to a −70° point. The second layer starts from the −70° point, passes the 0° point and ends at the +70° point with return being made to the −70° point. The third layer starts from the −70° point and ends at a +60° point with return being made to a −60° point. The fourth layer starts from the −60° point and ends at a +60° point with return being made to the −60° point. The fifth layer includes a winding portion starting from the −60° point and ending at a −10° point, which portion is connected by the hollow portion feed line 13 to a +10° point so that a hollow portion is provided from the 31 10° point to the +10° point. Then another winding portion of the fifth layer starts from the +10° point and ends at the +50° point with return being made to a −50° point. The sixth layer includes a winding portion starting from the −50° point and ending at a −20° point which is then fed up to a +20° point so that a hollow portion is provided from the −20° point to a +20° point with another winding portion of the sixth layer starting from the +20° point and ending at a +40° point. Thus, a winding end position of one winding layer and a winding start position of the next winding layer are approximately symmetric with respect to the vertical axis and the first, third, fifth and sixth winding layers are asymmetric with respect to the vertical axis 6.

Figure 9:
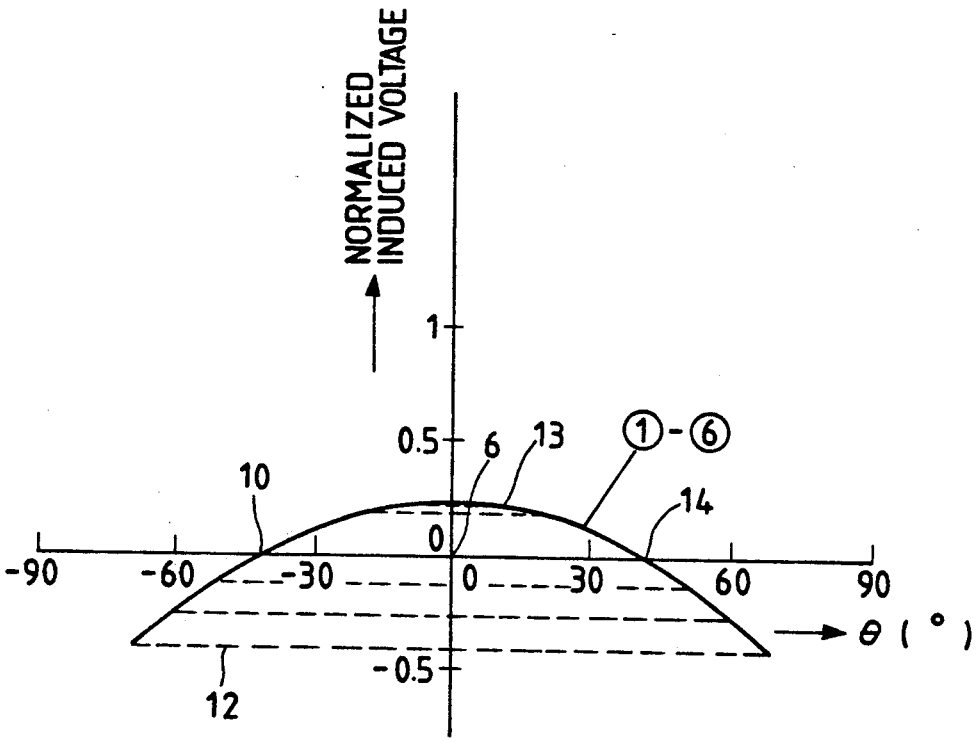
FIG. 9 is an explanatory view of induced voltages in the embodiment of FIG. 7.

FIG. 9 shows a distribution of normalized values obtained by dividing induced voltages Ei by K2, shown in the foregoing equation (2), for the winding of FIG. 7. According to a distribution curve of the normalized induced voltages shown in FIG. 9, if the induced voltage at the start of winding is 0, the induced voltage of the first layer increases from 0 at a −40° point with respect to the vertical axis and becomes a maximum at a 0° point, and after passing the 0° point, it decreases and becomes minimum at a +70° point with return being made to a −70° point. The induced voltage of the second layer increases from the −70° point and becomes a maximum at the 0° point, and after passing the 0° point, it decreases and becomes a minimum at +70° point. The induced voltage of the third layer increases from the −70° point and becomes a maximum at the 0° point and after passing the 0° point, it decreases and becomes a minimum at a +60° point. The induced voltage of the fourth layer increases from the −60° point and becomes a maximum at the 0° point, and after passing the 0° point, it decreases and becomes a minimum at the +60° point. The induced voltage of the fifth layer increases from the −60° point and becomes a maximum at a −10° point and the voltage is maintained up to the +10° point, from which point it decreases, and becomes a minimum at a +50° point. The induced voltage of the sixth layer increases from a −50° point and becomes maximum at a −20° point, and the voltage is maintained up to a +20° point, from which point it decreases, and becomes a minimum at a +40° point. As shown in FIG. 9, the inter-layer potential difference becomes 0 and resonance does not occur, even in the presence of the inter-layer floating capacity as 9 shown in FIG. 3, so it is possible to diminish ringing.

Figure 10:
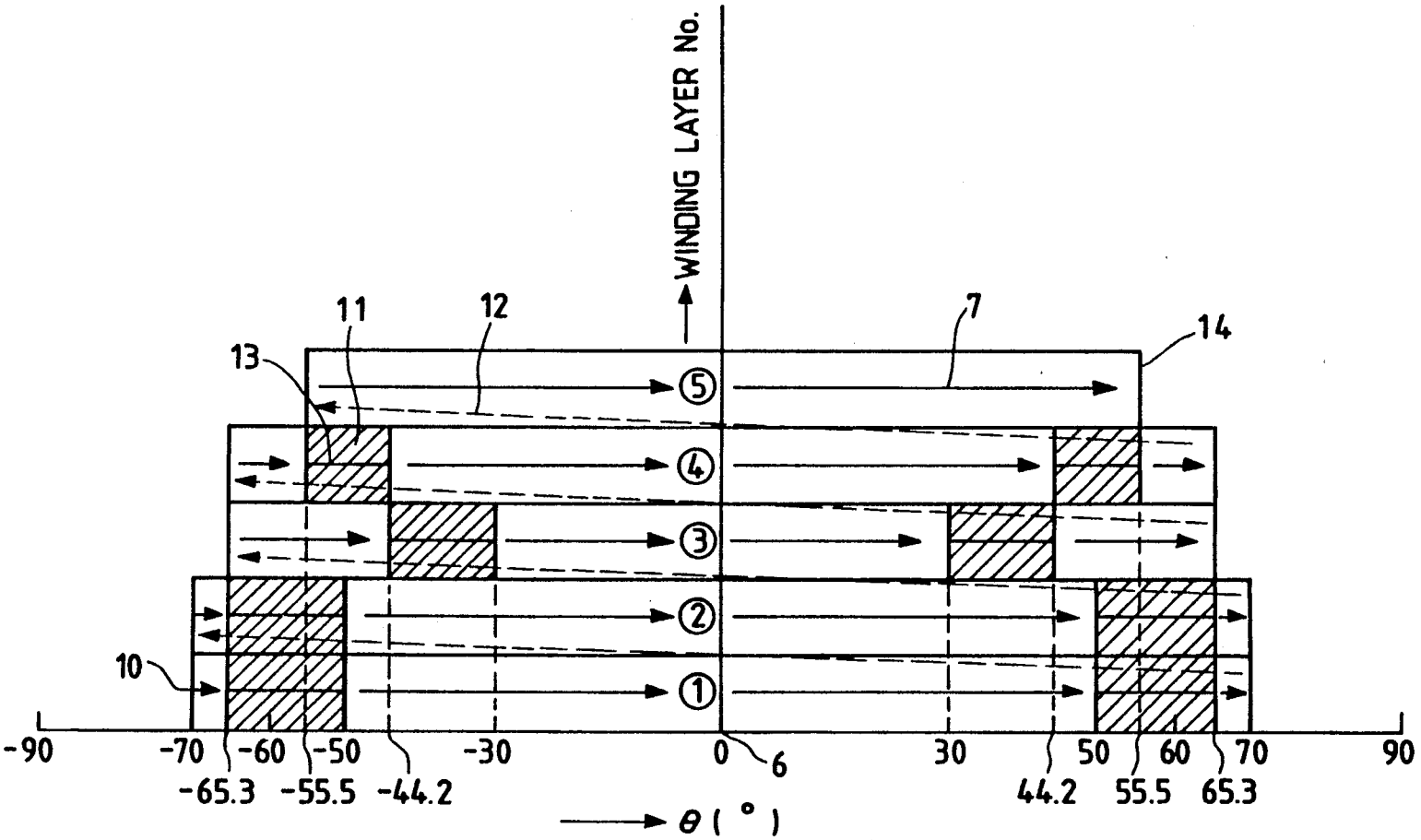
FIG. 10 is an explanatory view of a winding method in accordance with a further embodiment of the present invention.

A further embodiment of the present invention is illustrated in FIG. 10, which is an explanatory view of another winding method for the vertical deflection coil 3. In the figure, the first winding layer includes a portion starting from a −70° point with respect to the vertical axis 6 and ending at a −65.3° point which winding portion is then fed from the −65.3° point up to a −50° point so as to provide a hollow portion between the points −65.3° and −50°. Another winding portion of the first layer starts from the −50° point and ends at a +50° point, which winding portion is then fed from the +50° point up to a 65.3° point so that a hollow portion is provided between the points +50° and +65.30. A further winding portion of the first layer starts from +65.30 point and ends at a +70° point return being made to −70° point. The second layer is wound in the same way as in the first layer. The third layer includes portion starting from the −65.3° point and ending at a −44.2° point, which winding portion is fed from the −44.2° point to a −30° point so that a hollow portion is provided between the points −44.2° and −30°. Another winding portion of the third layer starts from the −30° point and ends at a +30° point, which portion is then fed from the +30° point to the +44.2° point so that a hollow portion is provided between the points +30° and +44.2°. A further winding portion of the third layer starts from a +44.2° point and ends at a +65.3° point with return being made to the −65.3° point. The fourth layer includes a winding portion starting from the −65.3° point and ending at a −55.5° point, which portion is fed from the −55.5° point to a −44.2° point so that a hollow portion is provided between the points −55.5° and −44.2°. Another winding portion of the fourth layer starts from the −44.2° point and ends at +44.2° point, which portion is fed from the +44.2° point to the +55.5° point so that a hollow portion is provided between the points +44.2° and +55.5°. A further winding portion of the fourth layer starts from the +55.5° point and ends at a +65.3° point with return being made to the −55.5° point. The fifth layer starts from the −55.5° point and ends at the +55.5° point.

Figure 11:
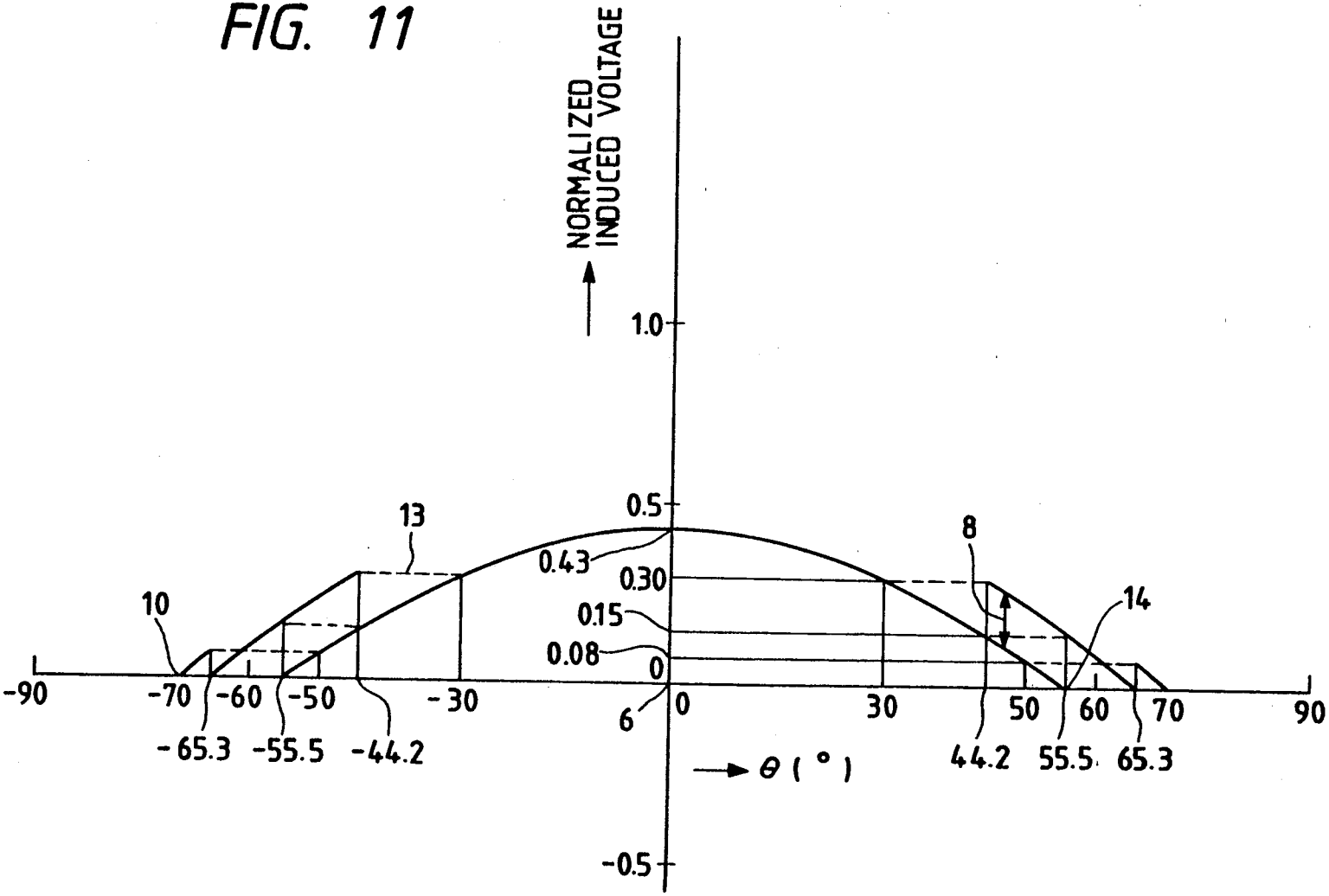
FIG. 11 is an explanatory view of induced voltages in the embodiment of FIG. 10.

In the entirety of the vertical deflection coil in this embodiment of FIG. 10, the winding density distribution is symmetric with respect to the vertical axis 6, in a manner as shown in FIG. 5. According to the winding method of this embodiment, the winding layers are weighted in induced voltage so that the winding layers are of the same potential in the vicinity of 0° as $\theta$, to keep the balance of turns. To this end, the winding density distribution is characterized by at least one winding layer having a hollow portion formed in a position not containing the vertical axis 6. As a result, normalized values obtained by dividing the induced voltage Ei by K2, shown in the foregoing equation (2), are distributed as shown in FIG. 11. In the distribution curve of normalized induced voltages shown in FIG. 11, if the induced voltage at the start of winding is assumed to be 0, since the winding starts from the −70° point with respect to the vertical axis 6, the induced voltage of the first layer increases from 0 at the −70° point and becomes 0.08 at −65.3° and then the voltage remains as it is up to the −50° point. The voltage then increases from the −50° point and becomes a maximum (0.43) at the 0° point and after passing the 0° point, it decreases. Then at the +50° point, the voltage becomes 0.08, and from the +50° point to the +65.3 point, the voltage remains as it is since a hollow portion is provided between the two points. Then from +65.3° point, the voltage decreases and becomes a minimum (0) at the +70° point. The induced voltage curve of the second layer is the same as that of the first layer.

The induced voltage of the third layer increases from the −65.3° point and becomes 0.30 at the −44.2° point. Then from the −44.2° point to the −30° point, the voltage does not change since a hollow portion is provided between the two points. Then the voltage increases from the −30° point and becomes a maximum (0.43) at the 0° point, and after passing the 0° point, the voltage decreases and becomes 0.30 at the +30° point. Then from the +30° point to the +44.2° point, the voltage does not change since a hollow portion is provided between the two points. Then from the +44.2° point the voltage further decreases and becomes a minimum at the +65.3° point.

The induced voltage of the fourth layer increases from the −65.3° point and becomes 0.15 at the −55.5° point. Then from the −55.5° point to the −44.2° point, the voltage does not change since a hollow portion is provided between the two points. Then from the −44.2° point the voltage increases and becomes a maximum (0.43) at the 0° point, and after passing the 0° point, the voltage decreases and becomes 0.15 at the +44.2° point. Then from the +44.2° point to the +55.5° point, the voltage does not change since a hollow portion is provided between the two points, and from the +55.5° point, the voltage decreases and becomes a minimum at +65.3° point.

The induced voltage of the fifth layer, which does not contain any hollow portions, increases from the −55.5° point and becomes a maximum at the 0° point. After passing the 0° point, the voltage decreases and becomes minimum at the +55.5° point.

Figure 1:
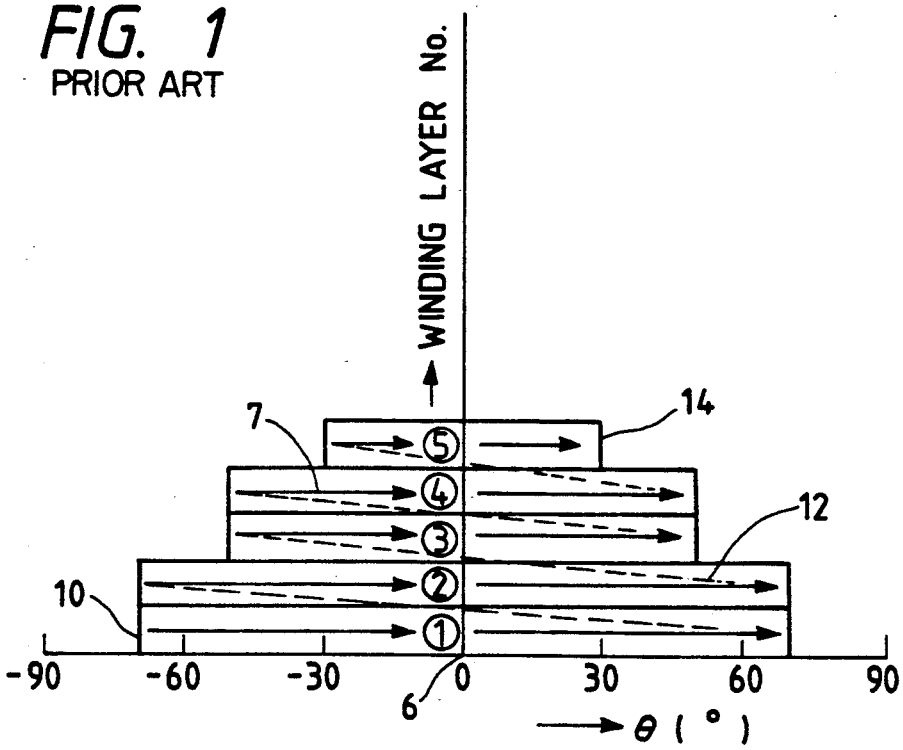
FIG. 1 PRIOR ART
FIG. 1 is an explanatory view of a conventional winding method.
Figure 2:
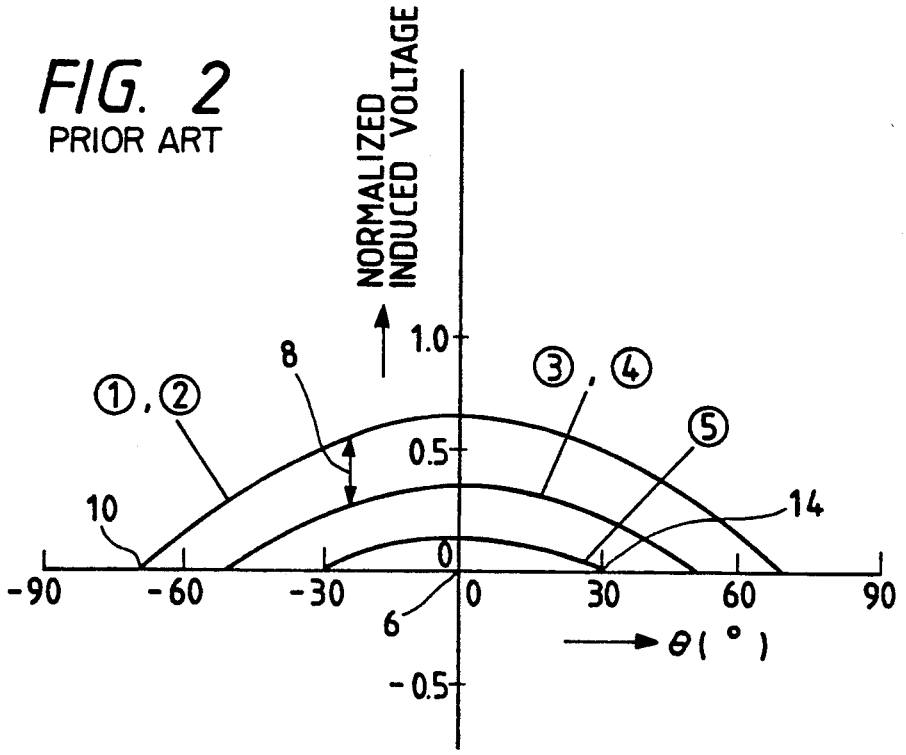
FIG. 2 PRIOR ART
FIG. 2 is an explanatory view of induced voltages in the conventional winding method.
Figure 3:
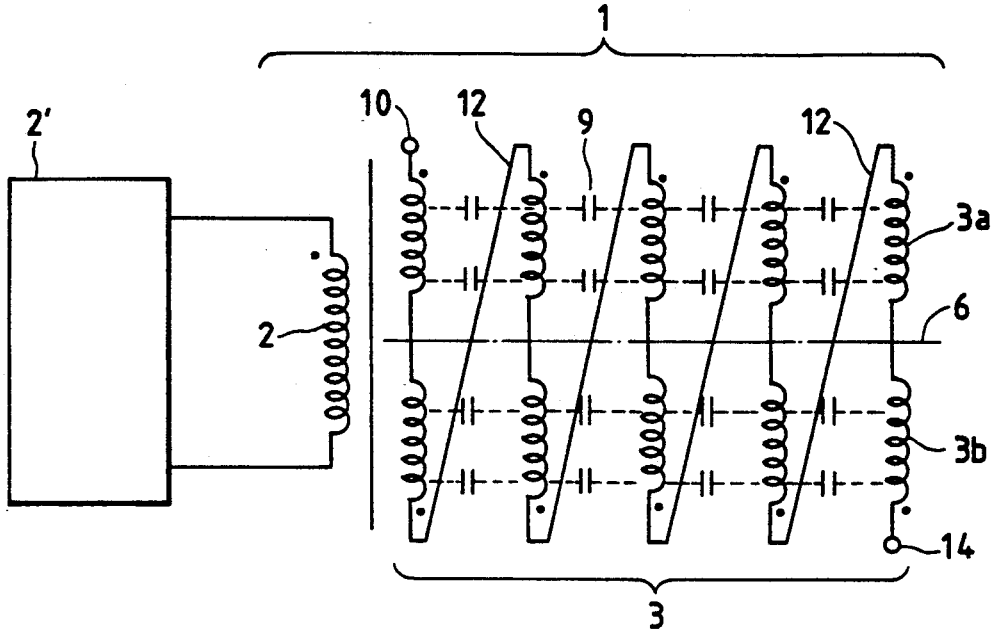
FIG. 3 is an electrical equivalent circuit diagram of the deflection system.

As is apparent from FIG. 11, while the embodiment of FIG. 10 results in an inter-layer potential difference 8 such inter-layer potential difference 8 can be greatly decreased as compared with that in the conventional winding method shown in FIG. 2, and the resonance based on the inter-layer floating capacity 9 shown in FIG. 3 can also be diminished. Consequently, it is possible with the aforementioned embodiment to diminish ringing which is caused by such resonance.

In accordance with the present invention, by merely changing the winding method for the vertical deflection coil, the inter-layer potential difference of the voltage induced in the vertical deflection coil by a horizontal deflection magnetic field can be made 0 or greatly decreased. As a result, the resonance based on the inter-layer floating capacity of the vertical deflection coil can be substantially prevented, so as to enable diminishing of ringing. Therefore, it is no longer required to use a damping resistor which has heretofore been used to diminish ringing, and it is possible to improve the working efficiency and decrease the manufacturing cost.

While we have shown and described several embodiments in accordance with the present invention, it is understood that the same is not limited thereto but is susceptible of numerous changes and modifications as known to those skilled in the art and we therefore do not wish to be limited to the details shown and described herein but intend to cover all such changes and modifications as are encompassed by the scope of the appended claims.

What is claimed is:

1. A deflection system for a cathode-ray tube comprising a horizontal deflection coil, a magnetic core and a vertical deflection coil toroidally wound on the magnetic core, the vertical deflection coil having means for substantially preventing ringing including a plurality of superimposed winding layers arranged with respect to a vertical axis of the deflection system, at least one of the layers of the vertical deflection coil being one of disposed asymmetrically with respect to the vertical axis and disposed symmetrically with respect to the vertical axis and having winding portions delimiting at least one gap along an extent thereof at a position other than the vertical axis so that an induced voltage in the at least one of the layers is substantially equal to an induced voltage in each of another of the layers at least in the region of the vertical axis.

2. A deflection system according to claim 1, wherein the at least one of the layers is disposes asymmetrically with respect to the vertical axis and has different angular start and end winding points with respect to the vertical axis, the winding end point of the at least one of the layers and a winding start point of an adjacent layer being disposed symmetrically with respect to the vertical axis.

3. A deflection system according to claim 2, wherein at least another one of the layers of the vertical deflection coil is disposed at least one of symmetrically and asymmetrically with respect to the vertical axis.

4. A deflection system according to claim 3, wherein the at least another one of the layers includes winding portions delimiting at least one gap along an extent thereof.

5. A deflection system according to claim 4, wherein the at least another one of the layers is provided with at least one gap along the extent thereof at a position one of containing the vertical axis and not containing the vertical axis.

6. A deflection system according to claim 5, wherein the at least one another layer includes at least first and second portions having winding turns closely adjacent one another, the first and second portions being spaced from one another to delimit the at least one gap.

7. A deflection system according to claim 1, wherein the at least one of the layers disposed symmetrically with respect to the vertical axis includes at least first and second portions having winding turns closely adjacent one another, the first and second portion being spaced from one another to delimit a first gap therebetween.

8. A deflection system according to claim 7, wherein the at least one of the layers includes a third portion having winding turns closely adjacent one another, the third portion being spaced from the second portion to delimit a second gap therebetween.

9. A deflection system according to claim 8, wherein the first and second gaps are symmetrically disposed with respect to the vertical axis.

10. A deflection system according to claim 7, wherein at least another one of the layers one of includes winding portions delimiting at least one gap along the extent thereof and is a continuous winding.

11. A deflection system according to claim 1, wherein the deflection system is mounted on a neck portion of a cathode-ray tube.

12. A cathode ray tube having a deflection system mounted on a neck portion thereof, the deflection system comprising a horizontal deflection coil, a magnetic core, and a vertical deflection coil toroidally wound on the magnetic core, the vertical deflection coil having means for substantially preventing ringing including a plurality of superimposed winding layers arranged with respect to a vertical axis of the deflection system, at least one of the layers of the vertical deflection coil being one of disposed asymmetrically with respect to the vertical axis and disposed symmetrically with respect to the vertical axis and having winding portions delimiting at least one gap along an extent thereof at a position other than the vertical axis so that an induced voltage in the at least one of the layers is substantially equal to an induced voltage in each of another of the layers at least in the region of the vertical axis.

13. A cathode ray tube according to claim 12, wherein the at least one of the layers is disposed asymmetrically with respect to the vertical axis and has different angular start and end winding points with respect to the vertical axis, the winding end point of the at least one of the layers and a winding start point of an adjacent layer being disposed symmetrically with respect to the vertical axis.

14. A cathode ray tube according to claim 13, wherein at least another one of the layers of the vertical deflection coil is disposed at least one of symmetrically and asymmetrically with respect to the vertical axis.

15. A cathode ray tube according to claim 13, wherein the at least another one of the layers includes winding portions delimiting at least one gap along an extent thereof.

16. A cathode ray tube according to claim 15, wherein the at least another one of the layers is provided with at least one gap along the extent thereof at a position one of containing the vertical axis and not containing the vertical axis.

17. A cathode ray tube according to claim 16, wherein the at least one another layer includes at least first and second portions having winding turns closely adjacent one another, the first and second portions being spaced from one another to delimit the at least one gap.

18. A cathode ray tube according to claim 12, wherein the at least one of the layers disposed symmetrically with respect to the vertical axis includes at least first and second portions having winding turns closely adjacent one another, the first and second portion being spaced from one another to delimit a first gap therebetween.

19. A cathode ray tube according to claim 18, wherein the at least one of the layers includes a third portion having winding turns closely adjacent one another, the third portion being spaced from the second portion to delimit a second gap therebetween.

20. A cathode ray tube according to claim 19, wherein the first and second gaps are symmetrically disposed with respect to the vertical axis.

21. A cathode ray tube according to claim 18, wherein at least another one of the layers one of includes winding portions delimiting at least one gap along the extent thereof and is a continuous winding.

* * * * *